United States Patent [19]

Eymard

[11] Patent Number: 4,993,342

[45] Date of Patent: Feb. 19, 1991

[54] KEELS OF CRAFT

[75] Inventor: Michel Eymard, Toulouse, France

[73] Assignee: Zodiac International, Issy les Moulineaux, France

[21] Appl. No.: 372,074

[22] Filed: Jun. 27, 1989

[30] Foreign Application Priority Data

Jun. 29, 1988 [FR] France ..... 88 08758

[51] Int. Cl.[5] ..... B63B 3/38

[52] U.S. Cl. ..... 114/140; 114/345; 441/40

[58] Field of Search ..... 114/121, 122, 125, 127, 114/140, 142, 283, 284, 288, 289, 290, 345, 346; 441/40

[56] References Cited

U.S. PATENT DOCUMENTS 2,370,069 2/1945 Patten ..... 114/345
3,503,358 3/1970 Moesly ..... 114/125
3,559,222 2/1971 Walker ..... 114/357

FOREIGN PATENT DOCUMENTS 196884 9/1986 Japan ..... 114/140
616373 3/1980 Switzerland ..... 114/125

*Primary Examiner*—Sherman Basinger
*Assistant Examiner*—Jesûs D. Sotelo
*Attorney, Agent, or Firm*—Larson & Taylor

[57] ABSTRACT

The craft incorporates a keel (3) essentially constituted by an elongated capacity (4) formed out of a flexible or resilient material which is distortable and watertight. A water inlet opening (6) is provided in the wall of this elongated capacity (4) oriented towards the bow of the craft and maintained in the open condition, in order to have the water back pressure prevailing in this elongated capacity (4) as soon as the craft is moving in the forward direction, said elongated capacity (4) being then at least partially filled with water.

8 Claims, 1 Drawing Sheet

KEELS OF CRAFT

This invention relates to keels intended for power-driven or sailing craft, such craft therefore comprising at least an underwater longitudinal element, hereafter designated "keel", serving the purpose of bestowing suitable sailing or navigation qualities upon the craft.

Heretofore, the keel(s) of a craft have been made of definitive and permanent structures, that is to say ensuring their function as a keel on a permanent basis, irrespective of the sailing conditions (craft at standstill, at low speed, or at high speed).

Thus, the keels known up to now could be:

either keels made up of a rigid structure which is mechanically maintained in position, or keels made up of a flexible or resilient structure maintained in a taut or extended condition by mechanical or pneumatic means.

In addition to the fact that the prior art keels are mounted during the building stage on a definitive and permanent basis (which proves a drawback), these keels are relatively fragile, of a not inconsiderable cost compared with the total cost of the craft and for certain types of keels, prove rather difficult to assemble.

The goal of the present invention is to remedy the whole of said drawbacks, whereby it provides a craft comprising at least one keel, the efficiency of which can be made to vary commensurate with the speed of the craft, and the material existence of which is open-ended (which means that the keel is not made up of a definitive and permanent structure and therefore can, depending upon the navigation or sailing conditions, ensure or not its function as a keel).

The goal of the present invention is also to provide a craft equipped with at least one keel, the characteristic of which is to be substantially less fragile than a conventional keel.

The goal of the present invention is also to provide a craft equipped with at least one keel, the characteristic of which is to be of a substantially lower relative cost (related to the total cost of the craft) than the cost of a conventional keel.

Another goal of the present invention is also to provide a craft equipped with at least one keel, the characteristic of which is to be capable of being more easily assembled than a conventional keel.

According to the invention, the craft incorporates at least one keel which is essentially made up of an elongated capacity out of a resilient or flexible sleeve material, distortable and watertight and is characterized in that this keel comprises at least one water inlet opening provided in the wall of the elongated capacity constituting the keel, oriented towards the bow of the craft to intercept water and which is kept opened.

Thanks to this arrangement, a dynamic water back pressure prevails in the keel as soon as the craft is propelled by a speed in the forward direction, said keel being then at least partially filled with water.

Preferably, this water inlet opening is located towards the rear part of the elongated capacity.

According to an advantageous arrangement of the invention, the elongated capacity is provided with at least one air removal orifice having substantially smaller dimensions (i.e. a ratio of approximately 1 to 10) than the ones of the water inlet opening.

Preferably, this air removal orifice is located opposite the water inlet opening, that is to say, that if said water inlet opening is located towards the rear part of the elongated capacity, the air removal orifice is located towards the front part of the elongated capacity.

According to another advantageous arrangement of the invention, retracting means are provided in such a way that:

when the water back pressure is nil or negligible, the elongated capacity occupies a totally or partially retracted position in the craft, and when the water back pressure reaches a sufficient critical value, the elongated capacity occupies an extended position in which it can ensure its function as a keel.

According to still another arrangement of the invention, there is provided, in the inside of the elongated capacity, an enclosure inflated with a gas under a pressure such that:

when the water back pressure is nil or negligible, the volume of the elongated capacity is almost completely occupied by this inflated enclosure, and, when the water back pressure reaches a sufficient critical value, approximately half of the volume of the elongated capacity is occupied by water.

Constructively, the water inlet opening can advantageously be arranged in the form of a scoop which is maintained in the open condition by stiffening, at least partially, around the opening, the material which constitutes the elongated capacity.

The invention embodies, apart from the above-mentioned arrangements, a certain amount of further arrangements, which can preferably be used at the same time, in which will be more explicitly described herein after.

The invention will at any rate be properly understood with reference to the following additional description as well as to the enclosed drawings, said additional description and drawings relate to preferred embodiments of the invention and are not to be construed as having a limiting character:

FIG. 1 in these drawings is a diagrammatic longitudinal section of a craft according to the invention;

Figure 1:
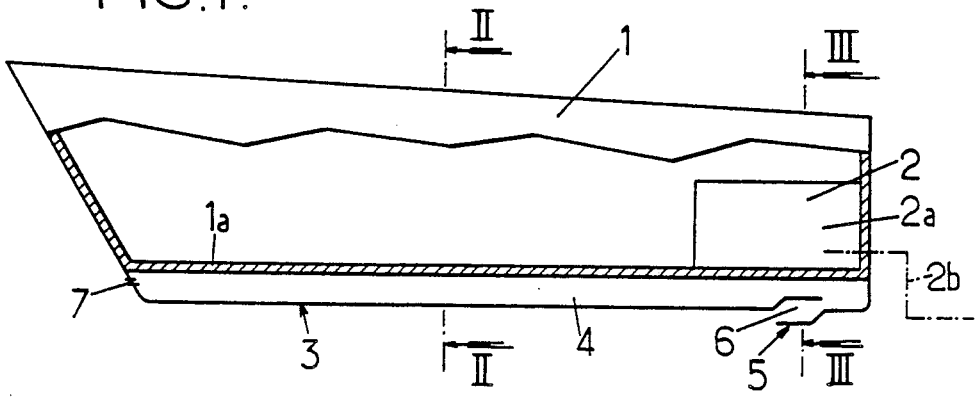

The craft shown in FIG. 1 comprises a hull 1 equipped with propelling means 2 (consisting for example of an "in board engine" 2*a* and a transmission in Z 2*b*).

The craft may have a flat bottom 1*a* and be provided with a keel which is generally designated by a reference numeral 3.

This keel 3 essentially consists of an elongated capacity 4 formed out of a sleeve made of a resilient material which is distortable and watertight.

Means, generally designated by the reference numeral 5, are provided in order to generate in this elongated capacity 4 the water back pressure as soon as the craft 1 is moving (in the forward direction), said elongated capacity 4 being then at least partially filled with water.

Figure 2:
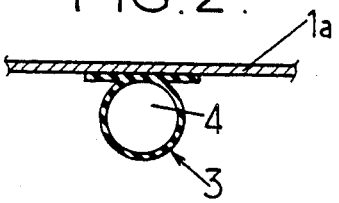
FIG. 2 is a section according to line II—II of FIG. 1.
Figure 3:
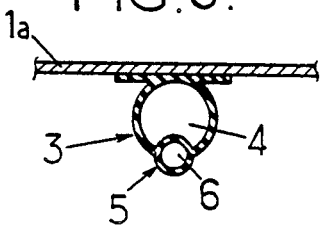
FIG. 3 is a section according to line III—III of FIG. 1.

As shown in FIGS. 1, 2 and 3, the means 5 intended for generating the water back pressure in the elongated capacity 4 as soon as the craft is moving, consists of a water inlet opening 6 provided in the wall of the elongated capacitY 4 oriented towards the bow of the craft and maintained in the open condition.

This water inlet opening 6 is preferably located towards the rear part of the elongated capacity 4.

Advantageously, the elongated capacity 4 may be provided with at least one air removal orifice 7 having dimensions substantially smaller than the ones of the water inlet opening 6; this air removal orifice 7 may be located in the part of the elongated capacity 4 which is situated opposite the water inlet opening 6.

If the water inlet opening 6 is located towards the rear part of the elongated capacity 4, the air removal orifice 7 is situated towards the front part of the elongated capacity 4.

Figure 4:
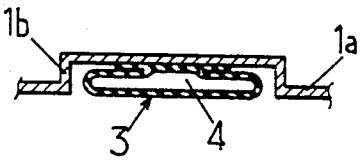
FIGS. 4 and 5 show, with sections analogous to the one shown in FIG. 2, an advantageous arrangement of the invention.
Figure 5:
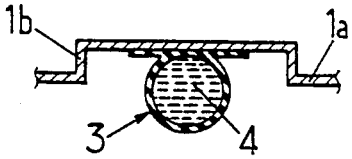

According to an arrangement of the invention which may prove of interest whenever it is desired to have a craft with a retracted keel at standstill, whereas it is made active when sailing or navigating, retracting means are provided in such a way that whenever the water back pressure is nil or negligible, the elongated capacity 4 occupies a totally or partially retracted position in the craft (FIG. 4), and whenever the water back pressure reaches a sufficient critical value, the elongated capacity 4 occupies an extended position in which it can ensure its function as a keel (FIG. 5).

In FIG. 4 in which same reference numerals designate the same elements as in FIG. 2, the keel as shown in its retracted position in the bottom 1*a* of the craft which, to this purpose, may incorporate a housing 1*b* adapted to accommodate the keel in this retracted position.

In FIG. 5, the keel is shown in its extended position in which it makes a projection and, accordingly, ensures its function as a keel.

As regards the retracting means provided, they may be of a different nature and one may advantageously resort to resilient means consisting of the flexible material constituting the elongated capacity 4, i.e. a flexible resilient material which is the selected among a material featuring elastic or resilient properties which resiliently retracts to the position depicted in FIG. 4.

Figure 6:
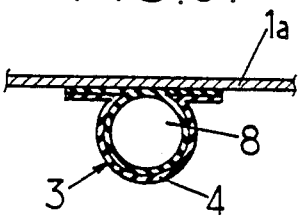
FIGS. 6 and 7 show, with sections analogous to the one shown in FIG. 2, another advantageous arrangement of the invention.
Figure 7:
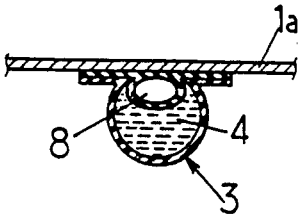
Figure 8:
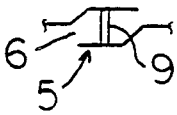
FIG. 8 shows, with a diagrammatic section portion analogous to the one shown in FIG. 1, another advantageous arrangement of the invention.

In FIGS. 6 and 7 in which identical numerals designate the same elements as in FIG. 2, there is shown a particular arrangement of the invention which makes it possible, even when the craft is at standstill, to have available a keel offering a certain amount of rigidity or stiffness.

According to this arrangement, there is provided, inside the elongated capacity 4, an enclosure 8 inflated with a gas under a pressure such that, whenever the water back pressure is nil or negligible, the volume of the elongated capacity 4 is almost completely occupied by this inflated enclosure 8 (FIG. 6), and whenever the water back pressure reaches a sufficient critical value, approximately half the volume of the elongated capacity 4 is occupied by water (FIG. 7).

In the configuration shown in FIG. 6, the keel of the craft offers a poor stiffness or rigidity due only to the gas pressure which prevails in the enclosure 8.

In the configuration shown in FIG. 7, the keel offers a higher stiffness, corresponding to the water back pressure which is equal to the gas pressure prevailing in the enclosure 8, said enclosure 8 having then its volume reduced to a lower value.

As regards the water inlet opening 6, it may advantageously be arranged in the form of a scoop maintained in the open condition by stiffening, at least partially, around the opening proper 6, the material constituting the elongated capacity 4.

The applications of the present invention are multiple and among the ones which seem to be the most interesting, the following ones can be cited:

central keel of an inflatable craft of the "ZODIAC Mark II" or "ZODIAC Mark III" type, central keel and/or lateral bulges of an inflatable craft of the "ZODIAC Futura" type, constitution of bilges on conventional craft.

It should also be pointed out that when the keel according to the present invention switches over from its "water-empty" configuration to its "water-full" configuration, its weight increases and its function as ballast can therefore become appreciable. It is then advantageous to provide the water inlet opening with reverse-lock means 9 preventing the water contained in the elongated capacity from flowing away due to gravity.

As a consequence, it can be contemplated applying the invention to the constitution of keels to serve the following purposes, constituting a keel and a central ballast in the case of a monohull craft, constituting a keel or a central ballast and/or a keel or a lateral ballast in the case of a multihull craft.

I claim:

1. A craft comprising at least one keel, said keel essentially constituted by an elongated capacity formed out of a distortable and resilient sleeve made of a watertight material and attached to a hull of the craft, said keel comprising at least one water inlet opening provided in a sleeve wall of said elongated capacity, said water inlet being oriented towards the bow of the craft and permanently maintained in fluid communication to the elongated capacity whereby a variable back pressure in the keel is created by the dynamic pressure of the intercepted water resulting from the variable speed of the craft moving in the forward direction.

2. A craft according to claim 1, wherein said water inlet opening is located towards the rear end of said keel.

3. A craft according to claim 1, wherein said water inlet opening is provided with reverse-lock means for preventing water contained in the elongated capacity from flowing away due to gravity.

4. A craft according to claim 1, wherein said keel is provided with at least an air removal orifice having dimensions substantially lower than the ones on the water inlet opening.

5. A craft according to claim 4, wherein said air removal orifice is located opposite said water inlet opening.

6. A craft according to claim 1, and further including a retracting means for at least partially retracting said elongated capacity against the craft whenever the water back pressure is nil or negligible and for allowing said elongated capacity to occupy an extended position in which it can ensure its function as a keel whenever the water back pressure reaches a sufficient critical value.

7. A craft according to claim 1, wherein there is provided, inside said elongated capacity an inflated enclosure occupied by a gas under a pressure such that whenever the water back pressure is nil or negligible, the volume of said elongated capacity is almost completely occupied by said inflated enclosure, and whenever the water back pressure reaches a sufficient critical value, the volume of said elongated capacity is almost completely occupied by water.

8. A craft according to claim 1, wherein said water inlet opening is arranged in the form of a scoop which is maintained in the open condition by stiffening at least partially around said opening the material constituting said elongated capacity.

* * * * *